United States Patent [19]

DeBoef et al.

[11] Patent Number: 4,472,914

[45] Date of Patent: Sep. 25, 1984

[54] DOUBLE GLAZING PANEL GASKET

[75] Inventors: Gene DeBoef; Terry Buhr, both of Pella, Iowa

[73] Assignee: Rolscreen Company, Pella, Iowa

[21] Appl. No.: 214,751

[22] Filed: Dec. 9, 1980

[51] Int. Cl.[3] ..... E06B 3/62

[52] U.S. Cl. ..... 52/202; 52/398

[58] Field of Search ..... 52/202, 203, 398, 397, 52/171, 788, 790; 49/498

[56] References Cited

U.S. PATENT DOCUMENTS

| | | | |
|---|---|---|---|
| 1,867,074 | 7/1932 | Hill . | |
| 2,205,538 | 6/1940 | Owen | 189/78 |
| 2,228,358 | 1/1941 | Lowry | 189/64 |
| 2,384,929 | 9/1945 | Kaufmann | 189/64 |
| 2,716,783 | 9/1955 | Fegan | 52/202 |
| 2,848,762 | 8/1958 | Peterson | 52/202 |
| 2,877,515 | 3/1959 | Haas | 20/56.5 |
| 3,016,993 | 1/1962 | Owen | 52/398 |
| 3,038,217 | 6/1962 | Harris | 49/497 |
| 3,203,053 | 8/1965 | Lane et al. | 20/56.5 |
| 3,214,879 | 11/1965 | Ellingson | 52/202 |
| 3,438,166 | 4/1969 | Bakke | 52/398 |

FOREIGN PATENT DOCUMENTS

| | | | |
|---|---|---|---|
| 2239233 | 2/1973 | Fed. Rep. of Germany | 52/397 |
| 1224296 | 6/1960 | France | 49/497 |
| 553915 | 1/1957 | Italy | 52/397 |
| 1357006 | 6/1974 | United Kingdom | 49/497 |

OTHER PUBLICATIONS

Double Glazing Panel Gasket 30.

*Primary Examiner*—John E. Murtagh

*Attorney, Agent, or Firm*—Allegretti, Newitt, Witcoff & McAndrews, Ltd.

[57] ABSTRACT

In principal aspect, a double glazing panel gasket includes a compressible central gasket portion and a fin portion. The central gasket portion provides a moisture-tight seal between a double glazing panel frame and a sash glazing stop, under compression. The fin portion simultaneously applies pressure against the panel, in response to the compression, to provide a moisture-tight seal between the panel and the stop.

2 Claims, 4 Drawing Figures

Fig. 2
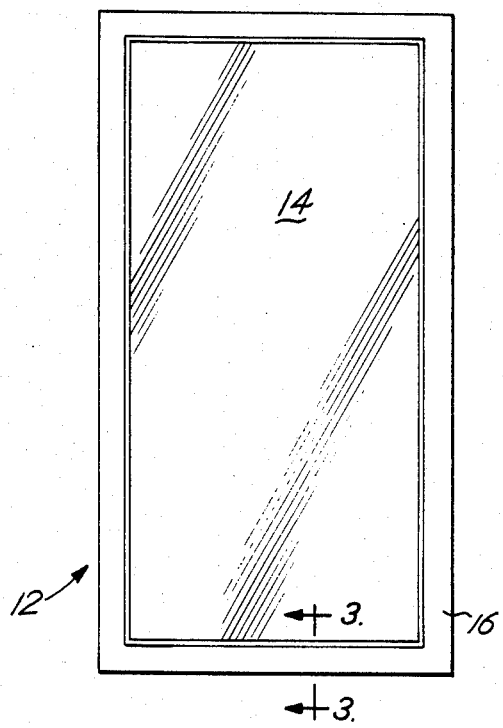
Fig. 4
(PRIOR ART)
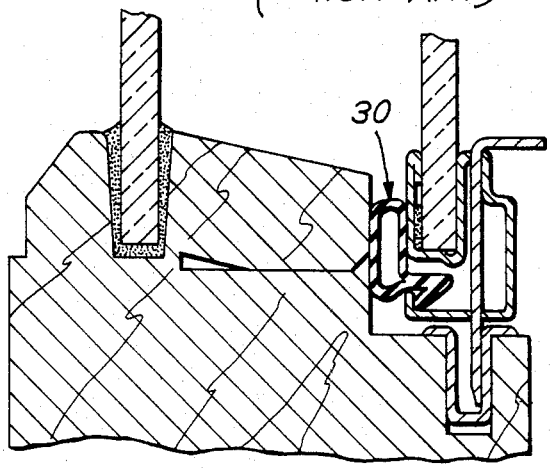
Fig. 3
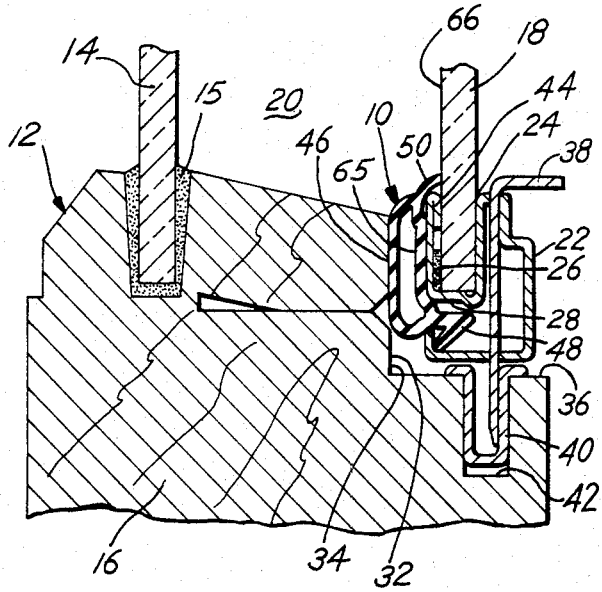
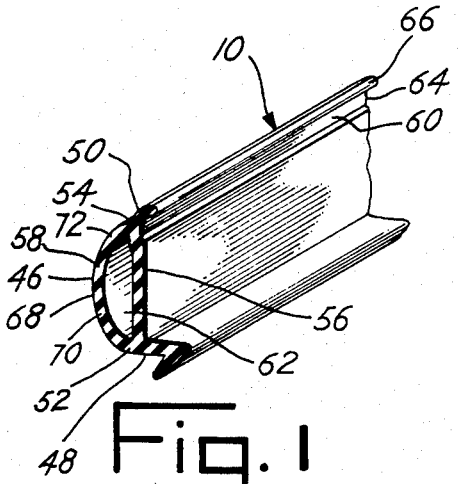
Fig. 1

DOUBLE GLAZING PANEL GASKET

BACKGROUND OF THE INVENTION

This invention relates to glazing panels, e.g., glass window panes, and most particularly to a double glazing panel gasket.

Traditionally, windows have been of single pane construction. As the cost of energy has increased, the demand for windows with greater insulating values has also increased. An improvement which has achieved greater insulating value is a window with a second pane on the interior side of the primary pane, with a suitable air gap between the two panes. A problem with this approach is the potential condensation between the two pieces of glass. "Between glass condensation" must be controlled by sealing the interior pane, i.e. the double glazing panel, around its perimeter so that moist interior air cannot migrate into the dead air space between the two panes. A common method of providing this seal has been the provision of a double glazing panel gasket 30 as shown in FIG. 4 of the accompanying drawing. While this gasket has been somewhat effective, the problem of condensation between glazing panels has remained significant.

SUMMARY OF THE INVENTION

It is an object of the present invention to provide an improved double glazing panel gasket for a window with a double glazing panel.

Another object of the present invention is to provide a double glazing panel gasket which reduces between-glass condensation as compared to prior art gaskets.

A further object of the present invention is to provide a double glazing panel gasket which retains significant features of the prior art gaskets, including an elongated hook for hooking the gasket in a channel of the double glazing panel frame.

This invention proceeds from the discovery that the effectiveness of the seal provided by a glazing panel gasket used with a double glazing panel having a frame depends not only upon a moisture-tight barrier between the double glazing panel and the sash glazing stop, but also also upon the continuity and integrity of the adhesive typically used to bond the double glazing panel frame to the double glazing panel. If the adhesive lacks continuity or integrity, the glazing panel gasket of the prior art cannot provide an effective seal. Moisture migrates into the dead air space between the doube glazing panel and frame, past the adhesive. While the adhesive is provided to be continuous and integral, it apparently frequently is not.

To effectuate this discovery and satisfy the above and other objects, the invention is, in principal aspect, a glazing panel gasket for sealing a glazing panel with a glazing panel frame to a sash glazing stop. The gasket comprises, first, compressible means for extending between, contacting and providing a substantially moisture-tight seal between the glazing panel frame and the sash glazing stop under compression thereof. The gasket also comprises, second, attached means for extending to, contacting and applying pressure against the glazing panel to provide a substantially moisture-tight seal between the glazing panel and the sash glazing stop in response to compression of the compressible means. Briefly, as preferred, the compressible means includes an elongated, compressible central gasket portion and the attached means includes an elongated fin portion attached to and extending outwardly from the central gasket portion. Compression of the central gasket portion between the glazing panel frame and the sash glazing stop moves the fin portion into sealing contact with the glazing panel.

BRIEF DESCRIPTION OF THE DRAWING

The preferred embodiment of the present invention will be described in relation to the accompanying drawing, the figures of which are briefly described as follows:

FIG. 1 is a perspective view of the preferred embodiment of the present invention;

FIG. 2 is a vertical elevation view of a window provided with the preferred embodiment of the invention;

FIG. 3 is a section view of the window of FIG. 2, taken along line 3—3 of FIG. 2; and FIG. 4 is a section view of a window provided with a prior art gasket, the figure being similar to FIG. 3.

DETAILED DESCRIPTION OF THE PREFERRED EMBODIMENT

Referring to FIG. 1 of the accompanying drawing, the preferred embodiment of the present invention is a double glazing panel gasket generally designated 10. The gasket 10 is principally for providing a moisture-tight seal between the interior of a home, office or the like and the space between two glazing panels or, more specifically, panes of glass, in a glazing panel assembly or window such as window 12 in FIG. 2.

As viewed from the exterior, as in FIG. 2, the window 12 can be seen to include a primary glazing panel or exterior pane 14 and a sash 16. The pane 14 is, as traditional, rectangular, planar and upright. The sash 16 is also rectangular, planar and upright. The sash 16 holds the pane 14 in position and an adhesive 15, shown in FIG. 3, secures the pane 14 in the sash 16.

As viewed in cross-section, as in FIG. 3, the window 12 further includes a double glazing panel or interior pane 18. The interior pane 18 is inward of the exterior pane 14 and substantially parallel thereto. The panes 14, 18 define a space 20 between the panes which is occupied by air. The space 20 greatly aids in insulating the interior of the home, office or the like from the exterior, by providing a significant barrier to heat transfer.

The interior pane 18 includes a double glazing panel frame 22. Four linear segments joined at miter joints (not shown) so as to form an open rectangle comprise the frame 22. The pane 18 is received in an inwardly-opening slot 24 of the frame 22 and held there by an adhesive 26. The gasket 10 is also received in a slot of the frame 22, slot 28.

It is the adhesive 26 which, because of discontinuities and lack of integrity, affects the effectiveness of prior art gaskets in preventing condensation in the space 20. Absent a continuous bead of adhesive 26 and with a prior art gasket 30, as in FIG. 4, moisture migrates into the space 20 through the slot 24, by passing between the interior pane 18 and the frame 22.

A sash glazing stop 32 is defined on the sash 16. The stop 32 is an L-shaped surface area extending about the sash 16 to form an open rectangle. The stop 32 includes a vertical surface strip 34 and a horizontal surface strip 36. The distance between upper and lower segments (not shown) of the strip 36 is substantially equal to the height of the pane 18. The distance between side segments (not shown) of the strip 36 is substantially equal to the width of the pane 18. Thus, when the pane 18 is in position, the frame 22 is adjacent the strips 34 and 36 all about the sash 16. The pane 18 is locked in position by pivotable locks 38, which co-operate with lock slot inserts 40 in slots 42 defined in the strips 36. In use, the gasket 10 is located between the inner, upright flange 44 of the frame 22 and the vertical surface strip 34 of the stop 32.

Referring again to FIG. 1, the gasket 10 includes a central gasket portion 46, a hooked portion 48 and a fin portion 50. Each portion 46, 48, 50 is elongated, extending throughout the length of the gasket 10. The portion 46 is the central portion of the three portions 46, 48, 50. The hooked portion 48 extends from one end or juncture 52 of the portion 46 and the fin portion 50 extends from the other end or juncture 54. The portions 46, 48, 50 are integrally formed from rubber or like resilient material.

The central gasket portion 46 has a first wall section 56 and a second wall section 58. The section 56 is substantially planar, with a relieved or recessed area 60. The section 58 is cross-sectionally rounded. The section 58 has a length in cross-section greater than that of the section 56. The sections 56, 58 are joined at the ends or junctures 52, 54, and constitute a gasket bulb. A bulbous space or compressible central cavity 62 is formed between the sections 56, 58.

The fin portion 50 extends in an overall direction away from the end 54 at an angle from the first wall section 56. More particularly, an attached or connected end 64 of the fin portion 50 extends outward from the central gasket portion 46 substantially in the plane of the first wall section 56. The fin portion 50 curves from the attached end 64 to a free fin end 66 substantially perpendicular to the plane of the first wall section 56 and in a direction opposite the extent of the second wall section 58.

For a rectangular application as in FIG. 2, a complete gasket 10 is formed of four gasket segments (not shown) with mitered and joined corners. The preferred means of joining is welding. The lengths of the segments are substantially equal to the lengths of matching segments of the flange 44 of the frame 22. In all embodiments, the gasket 10 has a central cavity 62.

An application of pressure across the wall sections 56, 58 of the central gasket portion 46 distorts the shape of the gasket 10. With the wall sections 56, 58 pressed between and against substantially planar strip surfaces, such as the strip surface 34 and the lateral surface 65 of the flange 44, the centermost area 68 of the second wall section 58 becomes substantially planar and the adjacent areas 70, 72 become more tightly rounded. As a result, the fin portion 50 pivots about the end 54, if permitted to do so. If restrained from pivotal movement by contact with a surface such as the surface 66 of the pane 18, the fin portion 50 applies pressure to the surface in response to compression of the central gasket portion 46. The pressure is sufficient to create a seal against a passage of moisture.

The gasket 10 so functions in the assembly 12. The lateral distance between the vertical surface 34 of the sash glazing stop 32 and the flange 44, when the pane 18 is locked in position, is such that the central gasket portion 46 of a gasket 10 placed therebetween is compressed. As a result, the central gasket portion 46 extends between, contacts and provides a substantially moisture-tight seal between the sash glazing stop 32 and the frame 22. Under the compression of the central gasket portion 46, the fin portion 50 applies a sealing pressure to the surface 66 of the pane 18. That is, the fin portion 50 extends to, contacts and applies pressure against the glazing panel or pane 18. The relieved area 60 compensates for any weld build-up at the corners of the gasket 10 or frame 22, and continues the seal about the corners of the pane 18.

The present invention, and the manner and process of making and using it, have now been described in such full, clear, concise and exact terms as to enable any person skilled in the art to which it pertains to make and use the same. The best mode contemplated by the inventors of carrying out the invention is set forth. To particularly point out and distinctly claim the subject matter regarded as the invention, the following claims conclude this specification.

What is claimed is:

1. A substantially moisture-tight double glazing panel assembly comprising:

a substantially rectangular primary glazing panel;

a substantially rectangular sash holding the primary glazing panel, the sash including a sash glazing stop;

a substantially rectangular double glazing panel with a double glazing panel frame, the frame defining a slot for receiving the double glazing panel, an adhesive bonding the double glazing panel to the double glazing panel frame, a path of undesirable moisture migration being defined throught the slot between the double glazing panel and the double glazing panel frame, the double glazing panel and frame being mounted on the sash adjacent the sash glazing stop; and a double glazing panel gasket including four segments forming an open rectangle, the gasket being for sealing the double glazing panel to the sash glazing stop and with each segment comprising compressible means for extending between, contacting and providing a substantially moisture-tight seal between the double glazing panel frame and the sash glazing stop under compression thereof, and attached means for extending to, contacting and applying pressure against the glazing panel adjacent the frame to provide a substantially moisture-tight seal across the path of moisture migration between the glazing panel and the sash glazing stop in response to compression of the compressible means, the compressible means including an elongated, compressible and compressed central gasket portion having a generally planar first wall section pressed against the frame and a cross-sectionally rounded second wall section distorted by compression against the sash glazing stop, the first wall section and the second wall section being joined at elongated junctures to define an elongated, compressible and compressed central cavity, and the attached means including an elongated fin portion attached to and extending outwardly from the central gasket portion at a juncture, the fin portion being thrustable and thrust into moisture-tight sealing contact with the double glazing panel across the path of moisture migration in response to the distortion of the second wall section of the central gasket portion.

2. A glazing panel assembly as in claim 1 in which the gasket segments are joined by welds and in which the compressible means defines a recess for accommodating the welds and maintaining a continuous seal.

* * * * *

UNITED STATES PATENT AND TRADEMARK OFFICE

CERTIFICATE OF CORRECTION

PATENT NO. : 4,472,914

DATED : September 25, 1984

INVENTOR(S) : Gene DeBoef and Terry Buhr

It is certified that error appears in the above-identified patent and that said Letters Patent is hereby corrected as shown below:

Column 1, line 44, delete "also".

Column 1, line 49, delete "doube" and substitute --double--.

Column 4, line 28, delete "throught" and substitute --through--.

Signed and Sealed this

*Ninth* Day of *April 1985*

[SEAL]

*Attest:*

DONALD J. QUIGG

*Attesting Officer* *Acting Commissioner of Patents and Trademarks*